US006752841B2

(12) United States Patent
Kang et al.

(10) Patent No.: US 6,752,841 B2
(45) Date of Patent: Jun. 22, 2004

(54) USE OF THICKENING AGENTS IN PATTERN DYEING OF TEXTILES

(75) Inventors: Peter K. Kang, Spartanburg, SC (US); Anthony R. Chambers, LaGrange, GA (US); Edwin Hersey, LaGrange, GA (US); Daniel T McBride, Chesnee, SC (US)

(73) Assignee: Milliken & Company, Spartanbrug, SC (US)

( * ) Notice: Subject to any disclaimer, the term of this patent is extended or adjusted under 35 U.S.C. 154(b) by 52 days.

(21) Appl. No.: 10/270,910

(22) Filed: Oct. 15, 2002

(65) Prior Publication Data

US 2004/0068806 A1 Apr. 15, 2004

(51) Int. Cl.[7] ..... D06P 1/50

(52) U.S. Cl. ..... 8/561; 8/478; 428/195.1; 442/59

(58) Field of Search ..... 8/478, 561; 442/59; 428/195.1

(56) References Cited

U.S. PATENT DOCUMENTS

| | | | | | |
|---|---|---|---|---|---|
| 4,033,154 | A | * | 7/1977 | Johnson | 68/205 R |
| 4,519,803 | A | | 5/1985 | Clare et al. | 8/445 |
| 4,808,191 | A | * | 2/1989 | Gregory et al. | 8/478 |
| 5,447,539 | A | | 9/1995 | Kelly et al. | 8/485 |
| 5,497,637 | A | | 3/1996 | Fuller et al. | 68/4 |
| 5,830,240 | A | | 11/1998 | Lin et al. | 8/478 |
| 5,944,852 | A | | 8/1999 | Lin et al. | 8/478 |
| 6,120,560 | A | * | 9/2000 | Miller et al. | 8/483 |

* cited by examiner

*Primary Examiner*—Margaret Einsmann
(74) *Attorney, Agent, or Firm*—Terry T. Moyer; George M. Fisher

(57) ABSTRACT

A process is disclosed for using thickening agents with specific properties in connection with the automated pixel-wise patterning of textile substrates using liquid dyes.

8 Claims, 2 Drawing Sheets

*FIG. –1–*

USE OF THICKENING AGENTS IN PATTERN DYEING OF TEXTILES

This invention relates to a process for dyeing a textile substrate in a predetermined pattern by dispensing an aqueous colorant using a plurality of individually-controllable colorant applicators. More specifically, this invention is directed to a process in which the dye or liquid colorant is used in combination with a thickening agent having specific properties. The use of thickening agents with such properties results in unexpectedly superior dyeing performance on the substrate as well as enhanced operation of the dyeing equipment.

BACKGROUND

Although the dyeing of textiles is among the oldest of arts, the subject continues to invite innovation and improvement. Among such innovations have been dyeing processes, and equipment to carry out such processes, that provide for the automated dyeing or patterning of textiles in accordance with electrically encoded patterning instructions. Such processes have evolved along two different approaches. In a first approach (the "drop on demand" approach), the dye or colorant is applied directly from valved applicators positioned over the textile substrate to be patterned. In an example of one such system, a valve is opened when the dye or colorant is to be dispensed onto the substrate, and is closed when the requisite quantity of dye has been delivered to the appropriate predetermined area of the substrate. Examples of this first approach include the patterning devices distributed by Zimmer Machinery, Inc. of Spartanburg, S.C. under the trade name Chromojet®. In such devices, a print head containing a plurality of individual dye nozzles is traversed across the path of a substrate to be patterned. One or more dye nozzles may be separately connected to individual dye supplies, each of which may supply dye of a different color and provide for multi-color patterning. Electronically defined patterning instructions are directed to selected nozzles as the print head is traversed and the substrate is appropriately indexed forward.

In a second approach (the "recirculating" approach), a continuously generated dye solution stream is directed into a catch basin. The dye solution stream is diverted onto the path of a moving substrate by an intermittently-actuated (i.e., actuated in accordance with pattern data) transverse stream of air or other control fluid, thereby causing the dye solution to avoid the catch basin and strike the surface of the substrate for a time interval sufficient to dispense the quantity of dye specified by the electronically defined pattern data. An example of such a device is indicated in FIGS. 1–2, the details of which are discussed below, as well as in a number of U.S. Patents, including commonly-assigned U.S. Pat. Nos. 4,116,626, 5,136,520, 5,142,481, and 5,208,592, the teachings of which are hereby incorporated by reference.

In the devices and techniques described in the above-referenced U.S. patents, the substrate pattern is defined in terms of pixels, and individual colorants, or combinations of colorants, are assigned to each pixel in order to impart the desired color to that corresponding pixel or pixel-sized area on the substrate. The application of such colorants to specific pixels is achieved through the use of many individual dye applicators, mounted along the length of color bars that are positioned in spaced, parallel relation across the path of the moving substrate to be patterned. Each applicator in a given color bar is supplied with colorant from the same colorant reservoir, with different arrays being supplied from different reservoirs, typically containing different colorants. By generating applicator actuation instructions that accommodate the position of the applicator along the length of the color bar and the position of the color bar relative to the position of the target pixel on the moving substrate, any available colorant from any color bar may be applied to any pixel within the pattern area on the substrate, as may be required by the specific pattern being reproduced.

DETAILED DESCRIPTION

Figure 1:
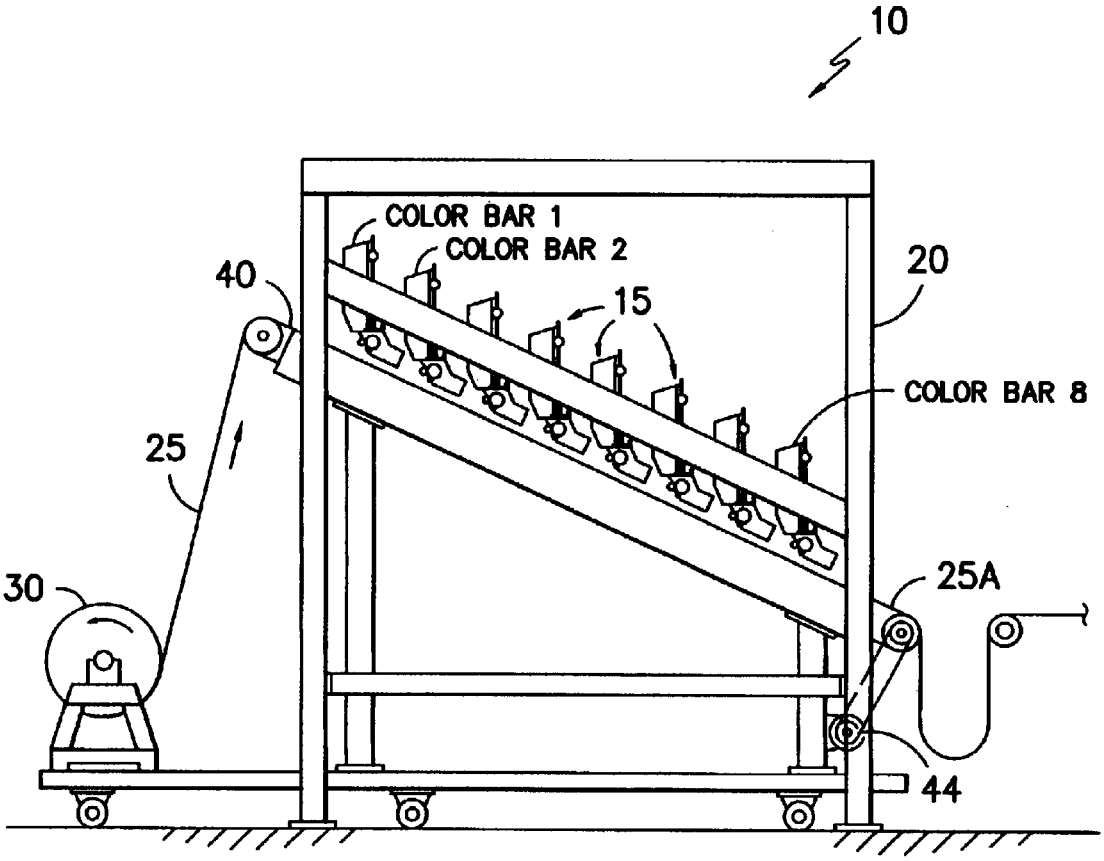
FIG. 1 schematically depicts an exemplary patterning device in which a plurality of individually controllable colorant applicators, arranged along the length of a series of color bars, are deployed across the path of a substrate web to be patterned.

FIG. 1 shows an exemplary jet dyeing apparatus 10, such as a Millitron® textile patterning machine developed by Milliken & Company of Spartanburg, S.C., comprised of a set of eight individual color bars 15, with each color bar capable of dispensing dye of a given color, positioned in fixed relationship within frame 20. A greater or fewer number of color bars may be used, depending upon the desired complexity of the apparatus, the need for a wide range of colors, and other factors.

Each color bar 15 is comprised of a plurality of individually controllable dye applicators arranged in spaced alignment along the length of the color bar and supplied with the colorant assigned to that color bar. The number of applicators per unit length of the color bar may be, for example, ten to the inch, twenty to the inch, or some other number. Each color bar extends across the full width of substrate 25. As depicted, unpatterned substrate 25, such as a textile fabric, may be supplied from roll 30 and is transported through frame 20 and under each color bar 15 by conveyor 40, which is driven by a motor indicated generally at 44.

After being transported under color bars 15 in a manner that provides for the accurate pixel-wise placement of dye solution in precisely-defined areas of the substrate, now-patterned substrate 25A may be passed through other, conventional dyeing-related steps such as drying, fixing, etc. For example, the pattern-dyed, textile material may be passed through a steamer wherein the dyed textile material is subjected to a steam atmosphere to fix the dyes thereon. The dyed textile material leaving the steam chamber may then be conveyed through a water washer to remove excess unfixed dyes and other chemicals. The washed textile material may then be passed through a hot air dryer to a delivery and take-up means. With appropriate modification of the transport mechanism, the substrate to be patterned may also be in the form of discrete units (e.g., individual carpet tiles, mats, or the like).

Figure 2:
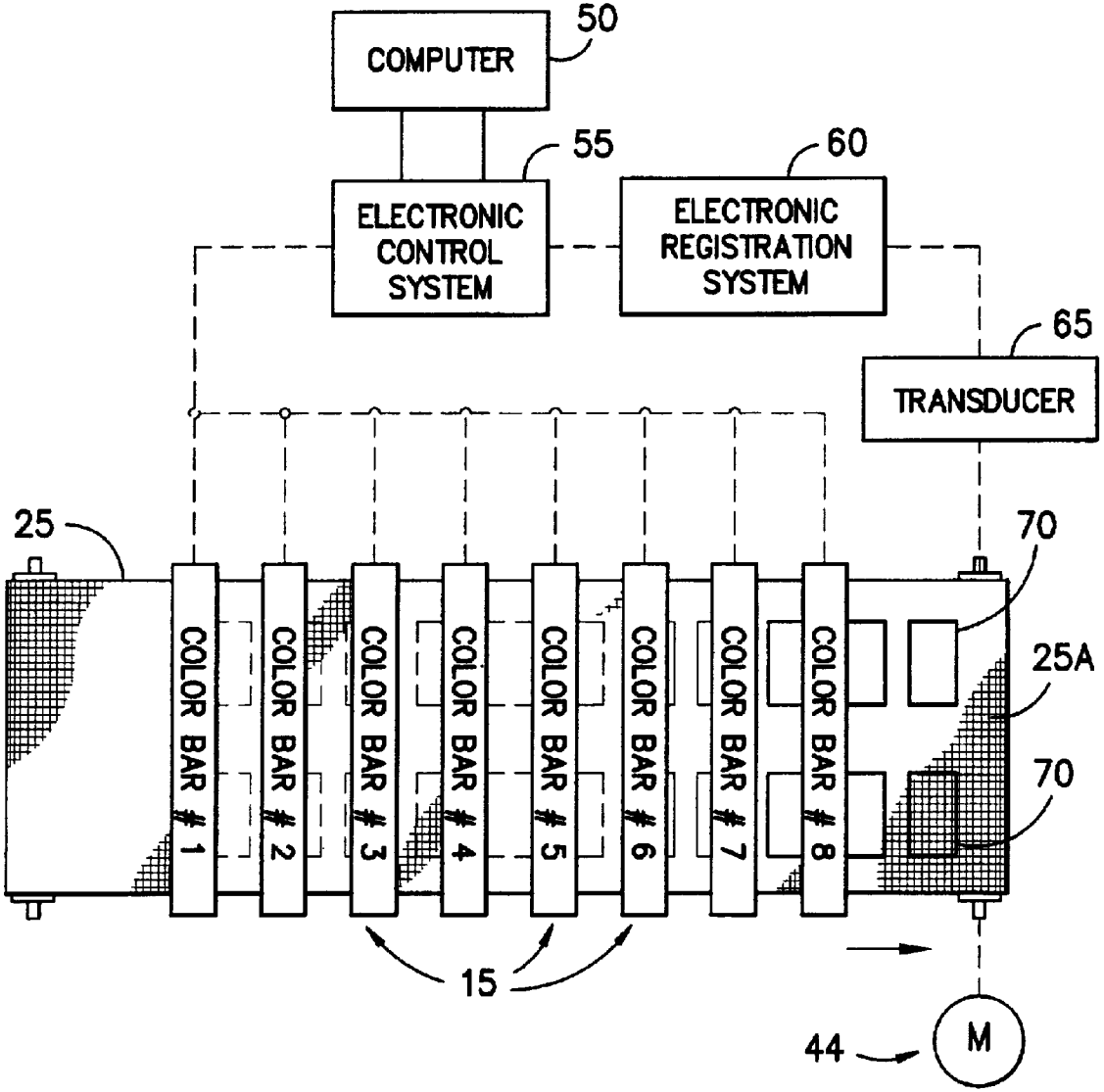
FIG. 2 schematically depicts a plan view of the device of FIG. 1, showing patterned areas of the substrate, intended to be uniformly colored.

FIG. 2 is a schematic plan view of the patterning device of FIG. 1. Included in this view are block representations of computer system 50 associated with electronic control system 55, electronic registration system 60, and rotary pulse generator or similar transducer 65. The collective operation of these systems results in the generation of individual "on/off" actuation commands that result in the accurate pixel-wise application, on the surface of moving substrate 25, of the dyes necessary to reproduce the desired pattern using the pattern-specified colors, as described in more detail in commonly-assigned U.S. Pat. Nos. 4,033,154, 4,545,086, 4,984,169, and 5,208,592, each of which is hereby incorporated by reference herein.

While the invention herein is described in terms of this recirculating-type device, the teachings herein are not limited to such devices, but may also be used with devices of the drop on demand type. With either approach, textiles may be patterned using a wide variety of natural or synthetic dyes, including acid, basic, reactive, direct, disperse, mordant, or pigments, depending upon the application and the fiber content of the substrate to be dyed. The teachings herein are applicable to the use of a broad range of such dyes, as well as a broad range of textile materials. Textile materials which can be pattern dyed by means of the present invention include knitted, woven, and non-woven textile materials, tufted materials, and the like. Generally, such textile materials may include floor coverings (e.g., carpets, rugs, carpet tiles, floor mats, etc.), drapery fabrics, upholstery fabrics (including automotive upholstery fabrics), and the like. Such textile materials can be formed of natural or synthetic fibers, such as polyester, nylon, wool, cotton and acrylic, as well as textile materials containing mixtures of such natural or synthetic fibers, or combinations thereof.

To facilitate the discussions below, the following definitions shall be used unless otherwise indicated or demanded by context.

The term patterning shall mean the selective application of dye, in accordance with predetermined data, to specified areas (or the total area) comprising the surface of a substrate. Patterning can involve arrangements of multiple colors, or the uniform application of a single color to the entire substrate.

The term pixel shall be used to describe the smallest area or location on the substrate to which a color or corresponding quantity of colorant can be accurately and reliably applied. Accordingly, the pixel is the basis on which patterns are defined and, for the patterning devices discussed herein, the basis for generating the dye applicator actuation commands required to reproduce those patterns. The derived term pixel-wise is used to describe the assignment or application of dye or other liquid to specific pixel-sized locations on the substrate, for example, as would occur in reproducing a pattern or pattern element defined in terms of pixels.

The term dye solution shall mean an aqueous mixture of various components, including dye (of any suitable kind) and, optionally, other additives such as are taught herein, that is dispensed onto the substrate. Dye solution is to be distinguished from "dye" or "colorant," the latter terms referring instead to the actual dye or colorant component of the dye solution.

The term aqueous thickeners shall mean any naturally occurring or synthetically derived viscosity enhancers suitable for use in an aqueous dye system. While numerous specific examples of such thickeners are known, it is believed that xanthomonas, acrylics, and guar and its derivatives are the most commonly used in connection with patterning processes of the kind described herein, and, of these, anionic biopolysaccharide thickening agents or xanthan gums, and particularly clarified xanthan gums, are generally preferred.

The term clarified shall mean subjected to additional processing steps for the purpose of removing filterable or water-insoluble impurities. As applied to xanthan gums, the term refers to gums that have been subjected to additional filtering and perhaps enzymatic removal of microbes or microbial-related debris. Non-limiting examples of clarified xanthan gums include Kelzan T® and Keltrol T®, distributed by C P Kelco of Wilmington, Del. For purposes herein, xanthan gums will be considered clarified if a 1% aqueous solution (distilled water) has a percent transmittance at 600 nm of not less than 40%. More specifically, xanthan gums will be considered moderately clarified if a 1% aqueous solution (distilled water) has a percent transmittance at 600 nm of not less than 60% and not greater than 75%, highly clarified if a 1% aqueous solution (distilled water) has a percent transmittance at 600 nm of greater than 75% and less than 85%, and hyperclarified if a 1% aqueous solution (distilled water) has a percent transmittance at 600 nm of greater than 85%, as measured at 25° C. in a bubble-free condition, with a path length of 1 cm and using an appropriately calibrated spectrophotometer (such as a UV/Vis Spectrometer UV2, distributed by UNICAM of Cambridge, England), when compared with a standard consisting of 100% distilled water.

The term substrate shall mean any substantially flat textile comprised of individual natural or synthetic yams. Substrates for which the processes described herein are particularly suited include fabrics and floor coverings, including carpets, rugs, carpet tiles, and floor mats.

The term face fiber shall refer to the total exposed or unexposed pile when referring to carpets and other floor covering products having a pile, to the total pile when referring to pile fabrics, and to the entire fabric when referring to flat fabrics.

The term level shall mean the degree to which areas of the substrate dyed the same color exhibit visually uniform color. Dyed areas having poor level exhibit a mottled appearance.

Despite the fact that various embodiments of both prior art dyeing approaches discussed above have met with considerable success, improvements in some areas of performance have been pursued. One such area involves the flow characteristics of the dye solution from the applicator to the substrate. For example, within those areas of a pattern that require the uniform application of one or more dyes, it is not unusual to find areas having non-uniform color levels resulting in dyed areas having a subtle but visually apparent mottling effect due to small but significant pixel-to-pixel non-uniformities associated with the delivery or flow of dye solution onto the substrate.

Additionally, areas of the pattern that require the delivery of a relatively small quantity of a specified colorant to one or more specific pixels may not receive the proper quantity of that colorant due to difficulties associated with starting and stopping a dye solution stream within a short time period. This area of performance, which shall be referred to as the applicator response time problem, can be at least partially responsible for several undesirable conditions.

Perhaps most apparently, the applicator response time problem restricts the relative proportions with which different colorants that can be applied to the same location on the substrate by limiting the degree to which relatively small quantities of colorant can be applied to the substrate. This effectively reduces the range of colors than can be produced by the technique of blending in place of two or more different colorants sequentially applied to the same pixel (known as "in situ blending"). This inability to generate with precision a relatively short burst of colorant on demand similarly limits the precision with which pattern lines may be initiated—the command to begin dispensing dye solution, sent to each applicator within a group of applicators may result in the slightly unsynchronized actuation of applicators within the group, thereby resulting in the generation of a ragged, uneven line at the leading edge of a pattern element.

Limitations related to dye solution flow rates have also presented problems in cases where it is desired to pattern substrates with a relatively high throughput rate. At such throughtput rates, the dye solution applicators must travel past the substrate at a relatively high speed. This places extraordinary requirements on the dye solution applicators in two respects: the valves must dispense the requisite quantity of dye solution at a relatively high flow rate, and must do so within a relatively short time interval in order to accommodate the shorter time during which various pixel areas defining the pattern on the substrate are operably positioned opposite the applicators. In many cases, such flow rates are difficult to achieve merely by increasing the pressure of the supplied dye solution or increasing the diameter of the applicator orifices, particularly where, for example, high resolution patterning is desired. Additionally, because the time interval during which these valves must open and close becomes shorter for a given pixel size, issues relating to the actuation and de-actuation performance of these valves, and the hydrodynamic performance of the dye solution during those intervals, become increasingly important.

An unexpected solution to the technical issues discussed above has been found in the observed effects of the use of specially prepared anionic biopolysaccharide thickening agents, specifically xanthan gums. When used in combination with the dye or colorant used to pattern the substrate, such thickening agents can provide a host of significant improvements to the process and the product, including, but not limited to, the following performance areas: (1) reduced valve response time, (2) reduced valve-to-valve variation, (3) increased flow rate for a given pressure and orifice size, (4) reduced filtration requirements, (5) increased dye penetration on the textile substrate, and (6) improved color uniformity (i.e., consistent color level).

In particular, it has been found that, while the functioning of ordinary xanthan gums with respect to the above performance areas is generally acceptable, performance levels in the above areas can be significantly enhanced through the use of clarified xanthan gums of the kind generally available through chemical suppliers. Additionally and independently, it has been found that use of xanthan gums that contain little or no glyoxal resin also tend to result in superior-performing dye solutions when compared with gums containing such resin. By using a clarified xanthan gum that is substantially free of glyoxal resins, it has been found that the individual benefits of each are substantially preserved and become additive, thereby yielding dye solutions with greatly enhanced performance in the areas listed above. For example, in one set of comparisons, dye solutions comprised of clarified, non-glyoxal-containing xanthan gum provided, on average, over 25% greater applicator flow rates when compared with a non-clarified, glyoxal-containing xanthan gum under similar conditions (same orifice size, supply pressure, etc.)

CP Kelco US, Inc., of Wilmington, Del. provides specific, but non-limiting, commercial examples of the xanthan gums discussed above. Kelzan S® is a non-clarified, glyoxal-containing xanthan gum that establishes a baseline; Kelzan® is a glyoxal-free version of Kelzan S®; Kelzan T® is a clarified version of Kelzan, and therefore is both clarified and glyoxal-free. Keltrol T® is a food-grade version of Kelzan T®, and is subjected to additional clarification processes. In trials conducted with the apparatus of FIGS. 1–3, the performance of the resulting dye solution in terms of the performance aspects 1 through 6 listed above improved in the order of the degree to which the xanthan gum was clarified and glyoxal-free. Accordingly, the preferred xanthan gum in this application from among the preceding Kelzan/Keltrol products is Keltrol T, followed in decreasing order of preference by Kelzan T and Kelzan, all of which outperform the baseline xanthan gum, Kelzan S. Similar gums are commercially available from a number of suppliers, such as ADM, of Decatur, Ill. and Federated Mills, Inc. of Windham, N.Y.

While it is anticipated that the most common technique for introducing such agents into the process will be as an additive to the dye solution prior to dispensing, if that is not possible or convenient, it is contemplated that such agents can also be introduced onto the substrate prior to the application of the dye solution using conventional equipment and conventional process steps. However, in that case, it is apparent that the advantages relating to dye solution applicator valve performance and filtration requirements would not apply. In such cases, the textile substrate 25 or 25A of FIGS. 1 and 2 (depending upon whether the additional treatment is performed before or after the patterning step) may be advanced over an appropriate set of support rollers into an optional pad bath, sprayer, or other conventional applicator, where an aqueous treatment solution, if desired, may be applied to the textile substrate, and then through a press roll, vacuum slot, or similar device designed to remove excess liquid from the substrate. Thereafter, the wet textile substrate may be passed to the patterning device of choice, with or without the presence of thickener in the dye solution. Generally, the addition of gum to the substrate prior to patterning improves the degree of leveling (i.e., color uniformity) observed in the patterned substrate.

Concentration of dye in the dye solution is totally dependent on the desired color but, in general, may be in a range that is conventional for textile dyeing operations, e.g. about 0.01 to about 2 percent, preferably about 0.01 to about 1.5 percent, by weight, based upon the weight of the dye solution, exclusive of the thickener. The amount of thickener added to the aqueous dye solution is selected to provide the desired viscosity appropriate to the particular pattern dyeing method. It should be understood that, in the case of using a plurality of different color dye solutions, the aqueous thickener and its concentration may be the same or different in each dye solution, although it is generally preferred to use the same thickener in all dye solutions.

In general, dyes are combined with a number of other constituents such as thickening agents, defoamers, wetting agents, biocides, and other additives to arrive at the dye solution that is dispensed by the patterning device. In general, amounts of thickener range from less than 0.1 to about 1.0 weight percent, based on the weight of the dye solution. As measured on the face fiber of the substrate, thickener concentrations ranging from about 0.05% to about 2.0% are commonly found, and thickener concentrations ranging from about 0.05% to about 0.5% have been found generally preferable (all percentages being by weight). The requirements for patterning systems in which the dye solution is recirculated, such as is depicted in FIGS. 1 and 2, are somewhat different from the requirements for patterning systems in which the dye solution flows only when the dye solution is to be directed onto the substrate. Although the relative proportion and precise composition of such additives for optimum performance will vary for each type of patterning device, it has been found that the novel teachings disclosed herein are applicable to the formulation of colorants for both kinds of patterning devices, and are capable of yielding superior results irrespective of the manner in which the colorant solution is dispensed onto the substrate surface.

For the device shown in FIGS. 1–2, dye solution viscosities within the range of about 50 to about 1,000 centipoise have been shown to be useful. Other devices, for example, those devices that use a non-recirculating dye solution system, such as the Chromojet® devices marketed by Zimmer Machinery, Inc., are believed to require, for best results viscosities within the range of from about 300 to about 3000 centipoise, depending upon the operating conditions (e.g., dye pressure and applicator orifice size). Note that all viscosity values listed herein are intended to be measured by a Brookfield LVT viscometer with No. 3 spindle, running at 30 rpm and 25° C.

While the invention has been described in connection with the embodiments discussed above, it is not intended to limit the scope of the invention to the particular form set forth, but on the contrary, it is intended to cover such alternatives, modifications, and equivalents as may be included within the spirit and scope of the invention as defined by the appended claims.

We Claim:

1. A textile substrate on which is defined a pattern comprised of areas containing a fixed dye and a clarified xanthan gum.

2. The substrate of claim 1 wherein said substrate is a floor covering and wherein said clarified xanthan gum is present at levels between 0.05% and 2.0% by weight of face fiber.

3. The substrate of claim 1 wherein said substrate is a floor covering and wherein said clarified xanthan gum is present at levels between 0.05% and 0.5% by weight of face fiber.

4. The substrate of claim 1 wherein said clarified xanthan gum is substantially free of glyoxal resins.

5. A process for the patterning of a textile substrate by the application of a liquid dye and a clarified xanthan gum to said substrate, said dye being applied in pixel-wise fashion by a plurality of applicators under the control of electrically defined pattern data.

6. The process of claim 5 wherein said clarified xanthan gum is added to said dye prior to the application of said dye to said substrate.

7. The process of claim 5 wherein said clarified xanthan gum is applied to said textile substrate prior to the application of said dye to said substrate.

8. The process of claim 7 wherein said clarified xanthan gum is substantially free of glyoxal resins.

* * * * *